US006811405B1

(12) United States Patent
Huang

(10) Patent No.: US 6,811,405 B1
(45) Date of Patent: Nov. 2, 2004

(54) CABLE CONNECTOR FOR CONNECTING CIRCUIT BOARD

(76) Inventor: Chung-Chuan Huang, No. 31, Lane 57, Chen-Nan First Street, Yuong-Kong City, Tainan Hsien (TW)

( * ) Notice: Subject to any disclaimer, the term of this patent is extended or adjusted under 35 U.S.C. 154(b) by 0 days.

(21) Appl. No.: 10/729,952

(22) Filed: Dec. 9, 2003

(51) Int. Cl.[7] ..... H01R 12/00
(52) U.S. Cl. ..... 439/63
(58) Field of Search ..... 439/63, 74, 79, 439/581, 55

(56) References Cited

U.S. PATENT DOCUMENTS 4,846,719 A * 7/1989 Iwashita ..... 439/63
5,334,050 A * 8/1994 Andrews ..... 439/579
6,106,304 A * 8/2000 Huang ..... 439/63
6,254,399 B1 * 7/2001 Huang ..... 439/63
6,468,089 B1 * 10/2002 Hubbard et al. ..... 439/63

* cited by examiner

*Primary Examiner*—Michael C. Zarroli
(74) *Attorney, Agent, or Firm*—Rosenberg, Klein & Lee

(57) ABSTRACT

A cable connector includes a wire extending from a center of an end of the cable and a tubular connector is connected to the end of the cable. A semi-circular plate extends from an end of the connector and two notches are defined in an end surface of the connector. A groove is defined in an inner periphery of the semi-circular plate so that hooking piece is pressed in the groove. Two ends of the hooking piece extend perpendicularly beyond two longitudinal sides of the semi-circular plate. The two notches engage with an edge of a circuit board and the two ends of the hooking piece are hooked into two holes in the circuit board. The wire is in contact with a contact point on the circuit board.

3 Claims, 6 Drawing Sheets

CABLE CONNECTOR FOR CONNECTING CIRCUIT BOARD

FIELD OF THE INVENTION

The present invention relates to a cable connector wherein the hooking piece is conveniently and securely connected to connector.

BACKGROUND OF THE INVENTION

A conventional cable connector 1 is shown in FIG. 1 and generally includes a semi-circular plate 12 extending longitudinally from an end of the cable and two notches 13 are defined in an end surface which is perpendicular to the axis of the cable. A groove 15 is defined in an end edge of the semi-circular plate 12 so that a hooking piece 11 are inserted in the groove 15 with two extensions 110 extending from two longitudinal sides of the semi-circular plate 12. A wire 14 extends from a center of the cable and is located between the two extensions 110 of the hooking piece 11. A circuit board 3 is engaged with the two notches 13 of the connector and the two extensions 110 of the hooking piece 16 are hooked with two holes 32 defined through the circuit board 3. The wire 14 is in contact with a contact point 31 located on a surface of the circuit board 3. It is noted that the groove 15 is difficult to be made in the limited area of the end edge of the semi-circular plate 12 and this often results failure in production.

FIG. 2 shows another embodiment of the conventional connector 1 which has the same structure except for that the groove in FIG. 1 is not necessary and the two extensions 120 are made to be integral with the semi-circular plate 12. Therefore, the notches 13 hold the circuit board 3 and the two extensions 120 are hooked in the holes 32 and the wire 14 is in contact with the contact point 31 on the circuit board 3. Nevertheless, once either one of the extensions 120 is broken, the whole connector has to be discarded.

The present invention intends to provide a connector wherein the hooking piece is pressed to be fitted into a groove defined in an inner periphery of the semi-circular plate so as to improve the shortcomings of the conventional cable connectors.

SUMMARY OF THE INVENTION

The present invention relates to a cable connector which comprises a cable with a wire extending from a center of an end of the cable. A connector is connected to the end of the cable and a semi-circular plate extends from an end of the connector. Two notches are defined in an end surface of the connector and a groove is defined in an inner periphery of the semi-circular plate. A hooking piece is pressed in the groove and two ends of the hooking piece extend perpendicularly beyond two longitudinal sides of the semi-circular plate.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
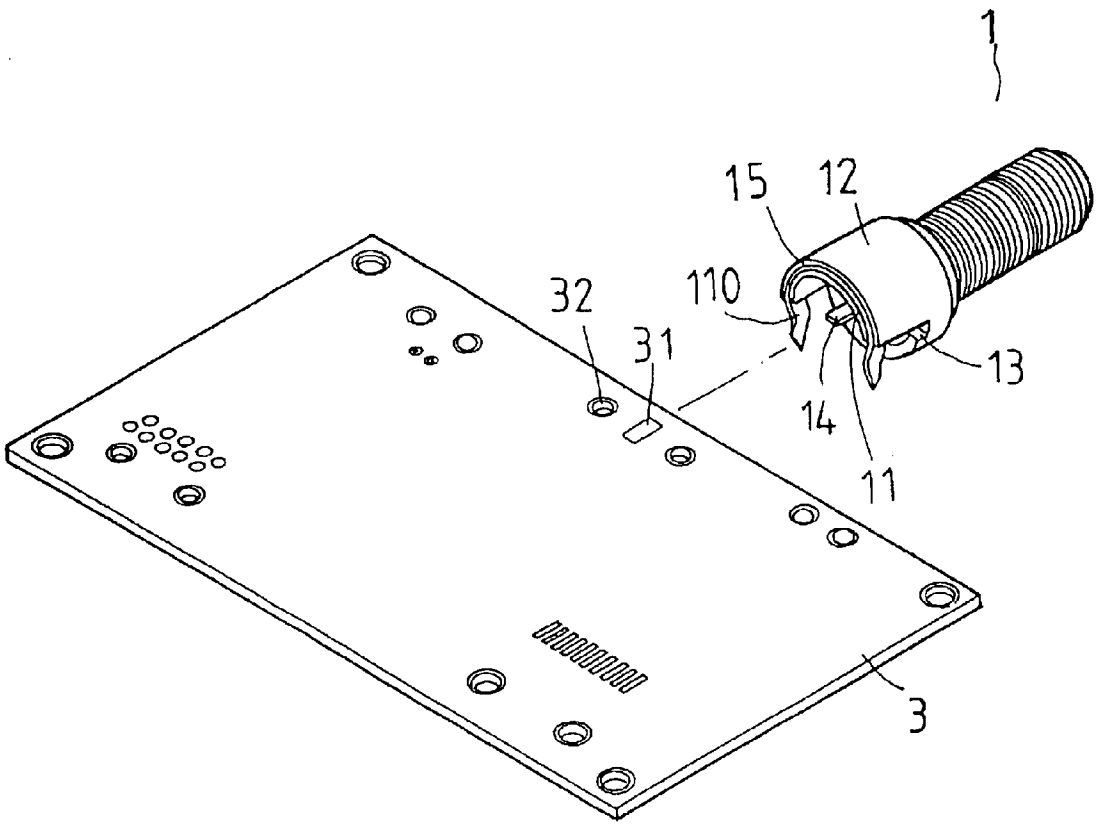
FIG 1 PRIOR ART
FIG. 1 shows a conventional cable connector and a circuit board.
Figure 2:
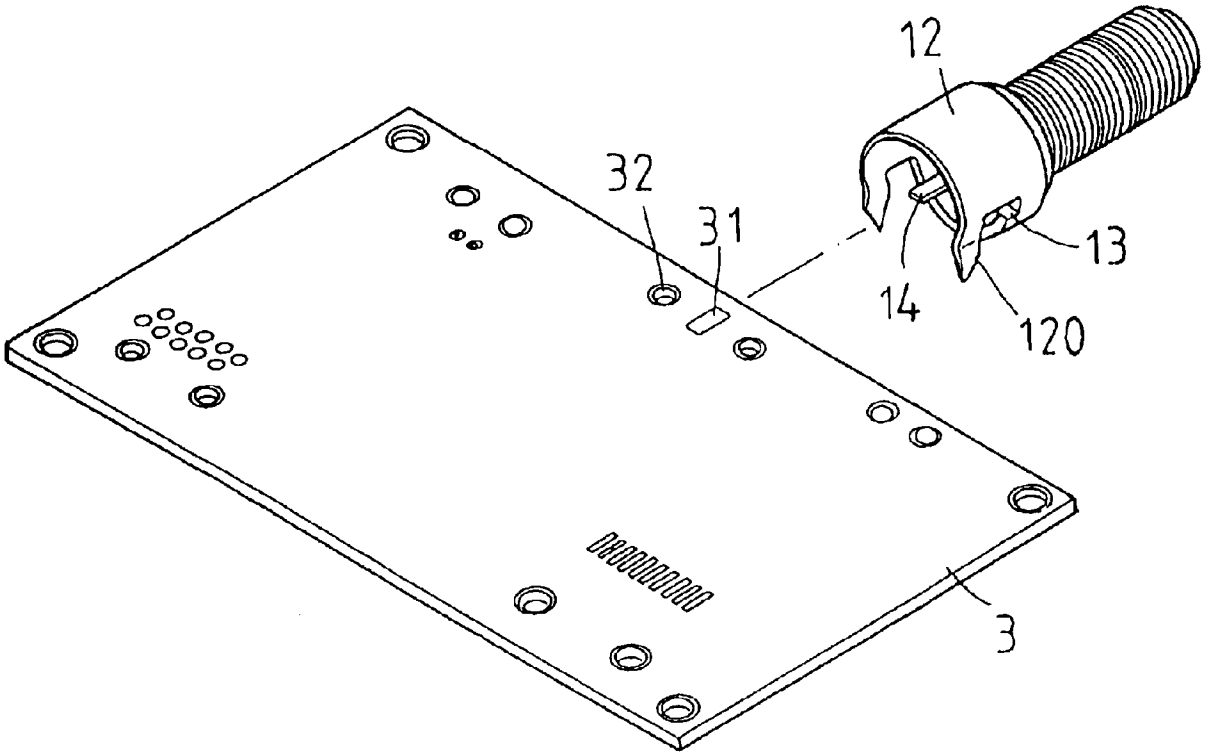
FIG 2 PRIOR ART
FIG. 2 shows another embodiment of the conventional cable connector and a circuit board.
Figure 3:
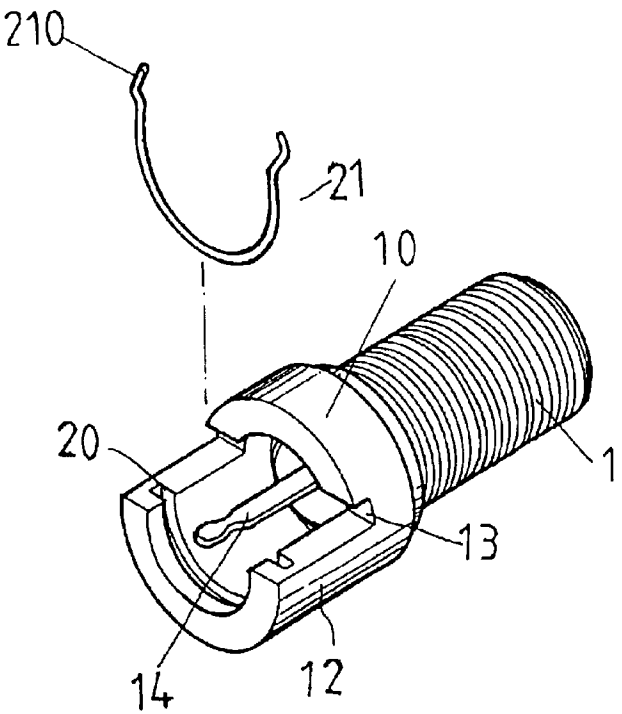
FIG. 3 shows a hooking piece and the cable connector of the present invention.
Figure 4:
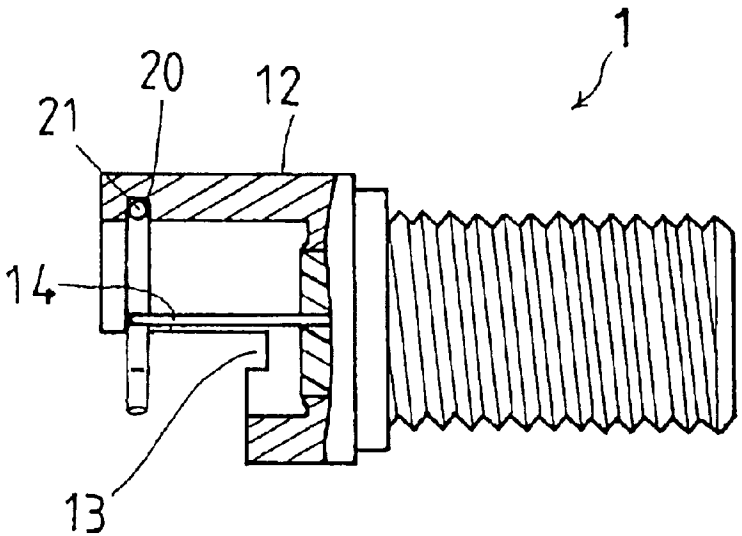
FIG. 4 is a cross sectional view to show the cable connector of the present invention.
Figure 5:
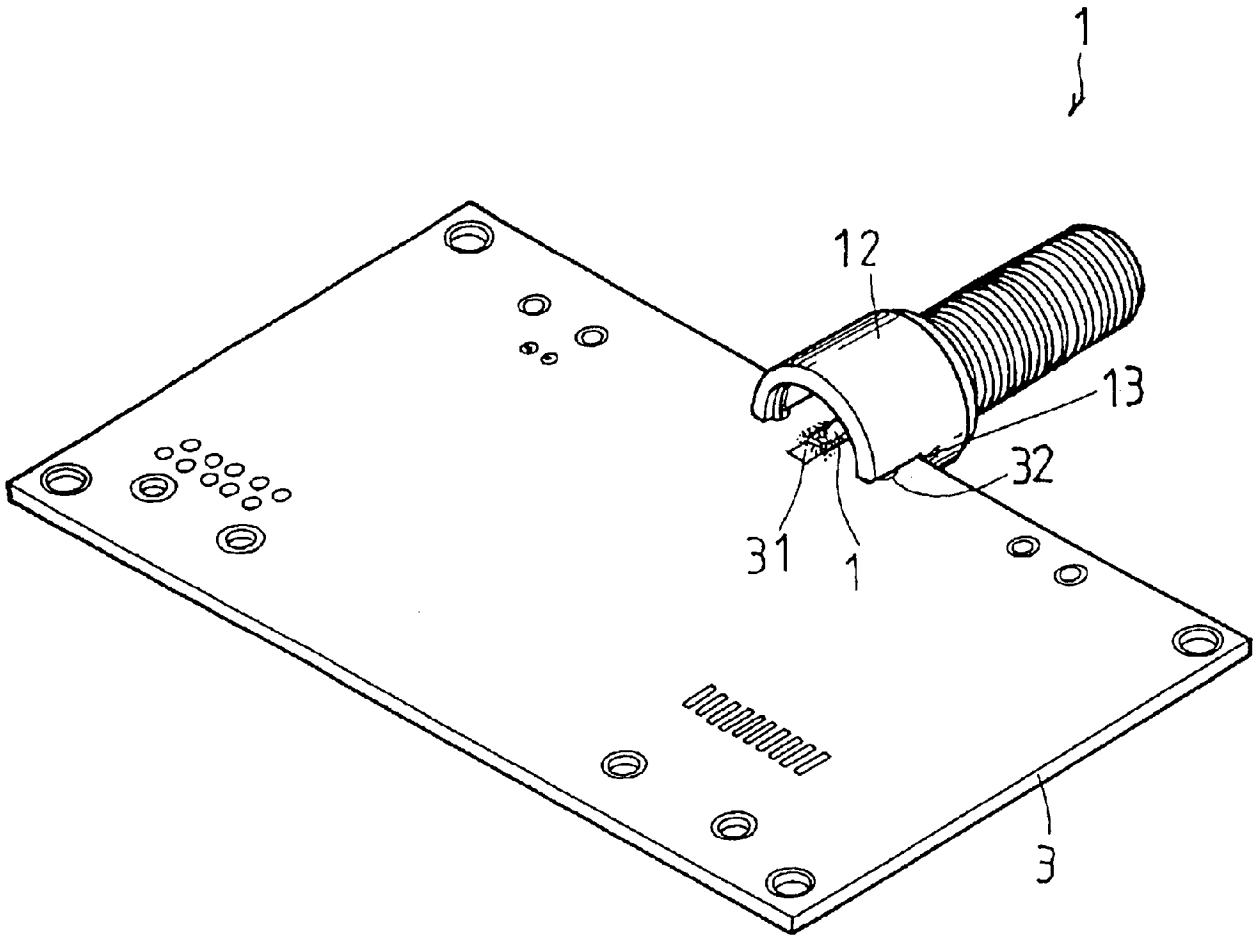
FIG. 5 shows that the cable connector of the present invention is connected to a circuit board.

Referring to FIGS. 3 and 4, the cable connector of the present invention comprises a cable 1 and a wire 14 extends from a center of an end of the cable 1. A tubular connector 10 is connected to the end of the cable 1 and a semi-circular plate 12 extends from an end of the connector 10. A groove 20 is defined in an inner periphery of the semi-circular plate 12. Two notches 13 are defined in an end surface of the connector 10.

Figure 6:
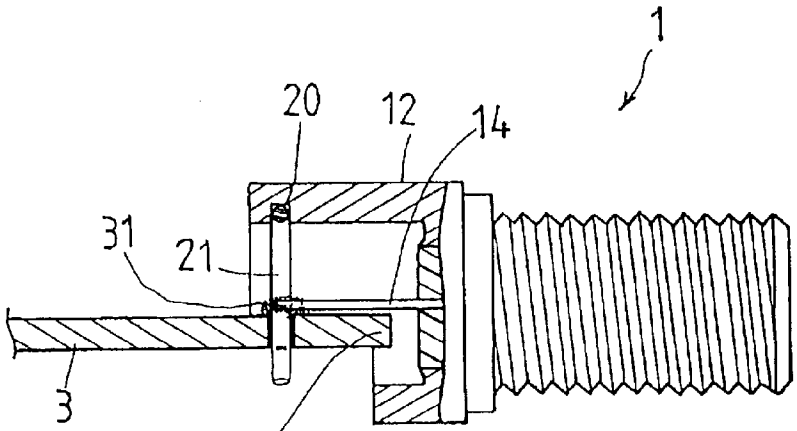
FIG. 6 is a cross sectional view to show the engagement of the cable connector of the present invention and the circuit board.
Figure 8:
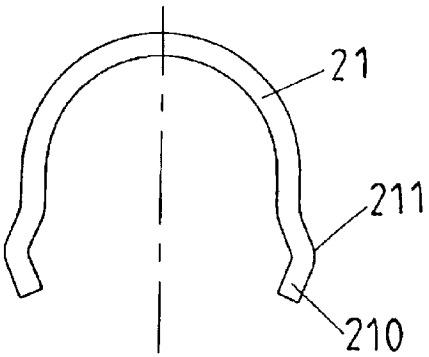
FIG. 8 shows an end view of the hooking piece of the present invention.
Figure 7:
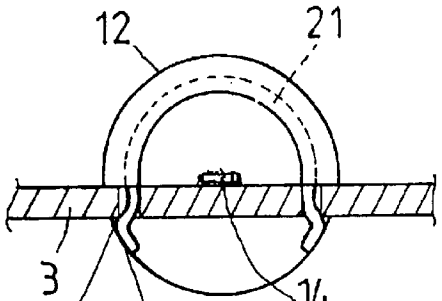
FIG. 7 is an end cross sectional view to show the two ends of the hooking piece hooked into two holes in the circuit board.

A hooking piece 21 which has a circular cross section as shown in FIG. 6 is pressed in the groove 20 and two ends of the hooking piece 21 extend perpendicularly beyond two longitudinal sides of the semi-circular plate 12. The circular cross section of the hooking piece 21 can be bent without worry of cracking or broken when compared with the hooking piece having rectangular cross section. Therefore, the hooking piece 21 is conveniently positioned in the groove 20 by several known methods. Further referring to FIG. 8, each of the two ends of the hooking piece 21 has a bent portion 210 which is formed by bending the hooking piece 21 outward at a distance from a distal end of each of the two ends of the hooking piece 21. A distance between two peaks 211 of the two bent portions 210 is longer than a distance between any two symmetric points on the hooking piece 21 relative to a symmetric line of the hooking piece 21. In other words, the two bent portions 210 provide sufficient flexible feature when engaging holes 32 in the circuit board 3 as shown in FIGS. 6 and 7.

The two notches 13 are engaged with an edge of the circuit board 3 and the two bent portions 210 are inserted in the holes 32 in the circuit board 3. The two bent portions 210 are forced inward when passing through the holes 32 and then biased outward to securely connect to the circuit board 3. The wire 14 is in contact with a contact point 31 on the circuit board 3.

The cable connector of the present invention eliminates the inherent shortcomings of the conventional cable connectors.

While we have shown and described the embodiment in accordance with the present invention, it should be clear to those skilled in the art that further embodiments may be made without departing from the scope of the present invention.

What is claimed is:

1. A cable connector comprising:

a cable and a wire extending from a center of an end of the cable;

a connector connected to the end of the cable and a semi-circular plate extending from an end of the connector, two notches defined in an end surface of the connector and a groove defined in an inner periphery of the semi-circular plate, and a hooking piece being pressed in the groove and two ends of the hooking piece extending perpendicularly beyond two longitudinal sides of the semi-circular plate, each of the two ends of the hooking piece having a portion bent to form a peak respectively thereon by bending the hooking piece outwardly at a distance from a distal portion of the end, a distance between the two peaks of the two bent portions being greater than a distance between any two points symmetrically displaced on the hooking piece relative to a center line of the hooking piece.

2. The connector as claimed in claim 1, wherein the hooking piece has a circular cross section.

3. A cable connector comprising:

a cable and a wire extending from a center of an end of the cable;

a connector connected to the end of the cable and a semi-circular plate extending from an end of the connector, two notches defined in an end surface of the connector and a groove defined in an inner periphery of the semi-circular plate, and a hooking piece having a circular cross-sectional contour and being pressed in the groove, the hooking piece having two ends thereof extending perpendicularly beyond two longitudinal sides of the semi-circular plate, each of the two ends of the hooking piece having a portion bent to form a respective peak extending outwardly therefrom a distance from a distal portion thereof for elastically engaging a circuit board through corresponding openings therein, a distance between the two peaks of the two bent portions being greater than a distance between any two points symmetrically displaced on the hooking piece relative to a center line of the hooking piece.

* * * * *